US005839315A

United States Patent [19]

Kubik

[11] Patent Number: 5,839,315

[45] Date of Patent: Nov. 24, 1998

[54] BEND-STRAIGHTENING MACHINE

[75] Inventor: Franticek Kubik, Wiesbaden-Delkenheim, Germany

[73] Assignee: Eitel Presses, Inc., Orwigsburg, Pa.

[21] Appl. No.: 819,414

[22] Filed: Mar. 17, 1997

[51] Int. Cl.[6] ..... B21D 3/16; B21D 7/06

[52] U.S. Cl. ..... 72/452.7; 72/389.1; 72/452.4; 100/292

[58] Field of Search ..... 72/389.1, 308.2, 72/390.3, 452.7, 452.6, 452.8, 452.4; 100/292

[56] References Cited

U.S. PATENT DOCUMENTS

| | | | |
|---|---|---|---|
| 1,032,218 | 7/1912 | Johnson | 72/390.3 |
| 1,994,034 | 3/1935 | Carrol | 72/390.3 |
| 2,489,125 | 11/1949 | Dyson | 72/390.3 |
| 3,415,103 | 12/1968 | Crawford et al. | 72/390.3 |
| 3,943,746 | 3/1976 | Eitel et al. | 72/389.1 |
| 4,203,308 | 5/1980 | Davis | 72/389.1 |

FOREIGN PATENT DOCUMENTS

| | | | |
|---|---|---|---|
| 922797 | 6/1947 | France | 72/390.3 |
| 42 15 795 C1 | 11/1993 | Germany . | |
| 248041 | 1/1948 | Switzerland | 72/452.7 |
| 428817 | 5/1974 | U.S.S.R. | 72/389.1 |
| 286973 | 3/1928 | United Kingdom | 72/452.7 |

*Primary Examiner*—David Jones

*Attorney, Agent, or Firm*—Anthony J. Casella; Gerald E. Hespos; Ludomir A. Budzyn

[57] ABSTRACT

The invention relates to a bend-straightening machine for long workpieces (7), said machine having workpiece holding fixtures (5) arranged on a machine table (3) to grip the ends of the workpiece (7) in a rotatable manner. The machine has at least two straightening bases (9) arranged a distance apart on the machine table for support of the workpiece in its longitudinal direction. At least one straightening ram (28) is provided between the straightening bases to act upon the workpiece. The straightening ram is mounted to an actuating mechanism which can be moved towards the workpiece and away from it by means of a driving mechanism (15). The invention provides for the actuating mechanism to be embodied as a bridge (17) which holds the straightening ram in the vertical alignment of the workpiece and which can be moved in a vertical plane by means of the drive mechanism. This design assures precise, directionally accurate straightening of the workpiece with a simple method of construction.

14 Claims, 1 Drawing Sheet

BEND-STRAIGHTENING MACHINE

Figure 2:
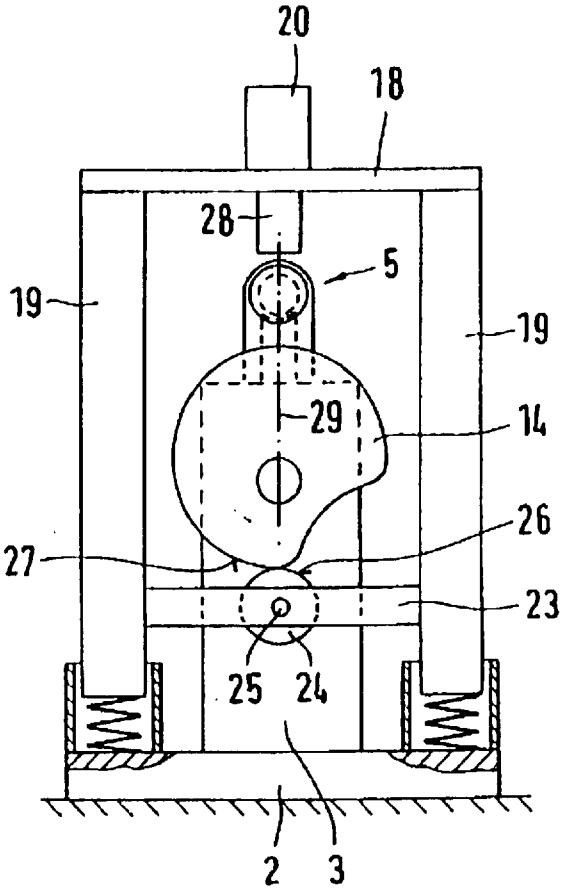

The invention relates to a bend-straightening machine for long workpieces, said machine having workpiece holding fixtures arranged on a machine table to grip the ends of the workpiece in a rotatable manner, having at least two straightening bases arranged a distance apart on the machine table for support of the workpiece in its longitudinal direction, having at least one straightening ram arranged between the straightening bases to act upon the workpiece, as well as having an actuating mechanism which holds the straightening ram and which can be moved towards the workpiece and away from it by means of a driving mechanism.

A bend-straightening machine of this type is known from DE 42 15 795 C1. In this case, the actuating mechanism is designed as a pivoting mechanism. It has a lever with two arms which is supported on a drag bearing located on the machine table, in which the connection with straightening ram is made by means of a pivoting head and the drive mechanism engages the free end of the other arm.

The known bend-straightening machine has fundamental disadvantages: The support of the straightening ram in a pivoting mechanism causes the effective direction of the straightening ram to be directed not in a linear direction over the total straightening travel, but rather in a circular path. This leads to an asymmetrical load on workpieces of varying diameter in their straightening process. In addition, the support of the pivoting mechanism in the machine table is costly and the design of the two-armed lever requires increased constructional expense.

The object of the present invention is to further develop a bend-straightening machine of the type stated above so that a precise, directionally accurate straightening of the workpiece is guaranteed with a simple method of construction. The component that holds the straightening ram and is arranged movably in relation to the machine table should be supported in it by simple means and should exert a symmetrical load on the workpiece independent of the diameter of the particular workpiece during the straightening action of the straightening ram. The load should be applied from a precise direction, specifically from above.

The objective is attained in a bend-straightening machine of the type stated above in such a manner that the actuating mechanism is designed as a bridge which holds the straightening ram in the vertical alignment of the workpiece and said bridge can be moved in a vertical plane by means of the drive mechanism. In this case of a rotationally symmetrical workpiece, vertical alignment is understood to be its axis.

Particular significance is attached to the design of the actuating mechanism in the form of a bridge in the bend-straightening machine in accordance with the invention. It is capable of holding the straightening ram by a simple means and can be moved only in a defined, vertical direction relative to the machine table. This causes a load to be exerted by the straightening ram onto the workpiece only from above, independent of the diameter of the workpiece. Thus, a symmetrical load can be exerted on the workpiece by a simple means. In accordance with a particular embodiment of the invention, the bridge is provided with legs located adjacent to the machine table as well as a crosspiece located above the machine table connecting the legs and holding the straightening ram. In the simplest embodiment, the bridge has two legs connected by the crosspiece. The crosspiece may also be designed as a horizontally arranged rectangular plate, the corners of which are engaged by the vertically positioned legs. In this case, the bridge is designed in the form of a table provided with four legs.

It is advantageous to support the bridge in a component fixed to the machine and is movable in relation to it, specifically in a base plate to which the machine table is mounted.

A particular embodiment of the invention provides for the bridge to be spring-mounted on the base plate in the region of its legs. The advantage of the spring mounting of the bridge can be seen in the fact that the drive mechanism exclusively serves the purpose of moving the straightening ram which is supported in the bride in the direction of the workpiece, and the latter against the force of the one or more springs which act between the base plate and the bridge. In principle, the bridge could also be spring mounted in the machine table.

Advantageously, the drive mechanism has a motor and a shaft propelled by it as fixedly mounted units and at least one cam disk fixedly joined to the shaft, said cam disk interacting with a projection of the bridge. The movement of the bridge plate thus takes place by means of the driven cam disk which interacts with the projection on the bridge. Basically, such a constructional design is suitable for producing both the downward movement as well as the upward movement of the bridge. If the projection rests against the outside of the cam disk and a spring exerting a restoring force acts upon the bridge, the spring ensures that the projection always rests against the cam disk and is more or less raised or lowered depending on the particular angular position of the cam disk. However, it is also conceivable to provide the disk with a groove in the shape of a curve in which the projection engages essentially without play when seen across the breadth of the groove. Depending on the angular position of the cam disk, the projection which produces the connection to the bridge is actively raised or lowered. The projection is advantageously designed in the form of a roller so that the relative motion between the projection and cam disk can take place largely without friction.

An embodiment of particularly simple design provides for the shaft to be rotatably supported on bearings in the machine table and for cam disks to be fixedly connected to the shaft at opposite sides of the machine table, said cam disks interacting with the projections.

If present, the springs producing the upward movement of the bridge should be designed as compression springs placed between each leg of the bridge and the base plate.

Additional features of the invention are presented in the dependent claims, the description of the drawings and in the drawings themselves, whereby it is pointed out that all individual features and combinations of individual features are essential to the invention.

Figure 1:
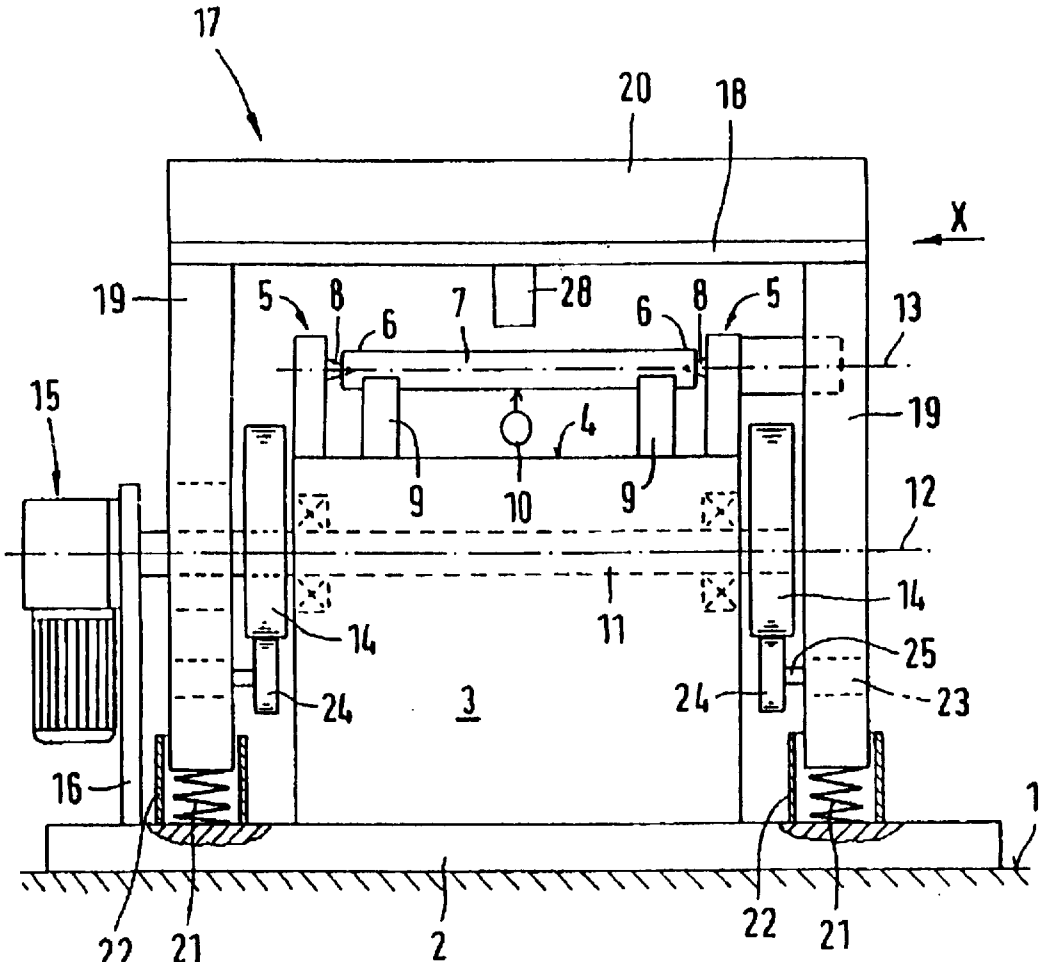

The invention is illustrated in the drawings by means of an exemplary embodiment without being limited to the latter. In schematic representation:

FIG. 1 shows a front view of the bend-straightening machine in accordance with the invention and FIG. 2 shows a side view of the bend-straightening machine as viewed along arrow X in FIG. 1.

A base plate 2 rests on the floor; in turn, an essentially rectangular machine table 3 rests on base plate 2 and is joined to it. In the region of its upper, horizontal surface 4, machine table 3 holds two workpiece holding fixtures 5. These serve to grip in a rotatable manner the ends 6 of a workpiece 7 which may, for instance, be present in the form of a cylindrical rod. The workpiece holding fixtures 5 are, for instance, in the form of spindle sleeves with centers 8, which engage matching countersinks in the ends of workpiece 7. In the region of its upper surface 4, the machine table is provided with two straightening bases 9 arranged at a distance apart and between workpiece holding fixtures 5 for support of workpiece 7 in its longitudinal direction. A measuring instrument 10 for determining the deflection of workpiece 7 is supported on machine table 3 and is centered between the two straightening bases 9.

A shaft 11 is rotatably supported on bearings and is at the same time fixed in an axial direction in machine table 3 below straightening bases 9. The axis of rotation 12 of shaft 11 is arranged parallel to the axis of rotation 13 of workpiece 7 and below it. Shaft 11 projects from both sides of machine table 3 and has a cam disk 14 fixedly mounted to it in the immediate vicinity of machine table 3. In the region of one of its ends, shaft 11 can be propelled by a drive mechanism 15 comprising an electric motor and a step-down gear unit. The drive mechanism 15 is supported on base plate 2 by means of a flange 16.

Machine table 3 is surrounded by a bridge 17. This bridge has a rectangular plate 18 arranged parallel to the upper surface of machine table 3, as well as four legs 19 which are joined to plate 18 in the regions of its corners. Plate 18 is designed to be resistant to bending by means of ribs 20 located above plate 18. The legs 19 of bridge 17 are located in the corner regions of the rectangular machine table 3 and are supported on compression springs 21 located between legs 19 and base plate 2. The lower ends of legs 19 are guided in sleeves 22 which are joined to base plate 2 and overlap the lower regions of legs 19. The two legs 19 of bridge 17 assigned to the particular cam disk 14 are connected in their upper region by means of a crosspiece 23. A roller 24 is rotatably supported on bearings in this crosspiece, whereby the axis of rotation 25 of roller 24 is arranged parallel to the axis of rotation 12 of shaft 11 and below it. The compression springs 21 acting on bridge 17 press the curved peripheral surfaces 26 of both rollers 24 which are joined to bridge 17 against the curved peripheral surfaces 27 of the cam disks 14 interacting with them. The cam disks are designed in such a way that the feed travel of bridge 17 corresponds to an angle of traverse of approximately 270° of the particular cam disk 14 in order the complete the bend-straightening operation.

In the vertical alignment of workpiece 7, plate 18 holds straightening ram 28 which can be moved with bridge 17. This straightening ram is arranged in vertical alignment between the two straightening bases 9 and is positioned symmetrically to plane 29 which passes through the axes 12 of shaft 11 and axis 13 of workpiece 7. This ensures that straightening ram 28 always acts on workpiece 7 precisely from above when bridge 17 is moved in a vertical direction, independent of the diameter of the workpiece.

The drawings illustrate the embodiment of the bend-straightening machine in accordance with the invention in a highly simplified representation. It is readily understandable that this machine can be extensively modified within the scope of the invention. Thus, the straightening support 9 and the straightening ram 28 are expediently movable in the longitudinal direction of workpiece 7, an additional drive mechanism to rotate the workpiece can be provided, and the feed travel of the bridge can also take place by suitable means other than cam disks.

What is claimed is:

1. A bend-straightening machine for straightening a workpiece, said machine comprising a machine table (3) having first and second spaced-apart side surfaces and an upper surface (4) extending therebetween, at least two workpiece holding fixtures (5) mounted to said upper surface (4) of said machine table (3), said workpiece holding fixtures (5) for rotatably supporting the workpiece, an inverted U-shaped bridge (17) having a crosspiece member (18) and two spaced-apart side members extending from said crosspiece member (18), said machine table (3) being interposed between said side members with said upper surface (4) facing said crosspiece member (18), said members of said bridge (17) being spaced from said surfaces of said machine table (3), a straightening ram (28) extending from said crosspiece member (18) towards said upper surface (4), and a drive mechanism for reversibly raising and lowering said bridge (17) relative to said machine table (3), said drive mechanism including a projection (24) extending from each of said side members towards corresponding said side surface of said machine table (3), a shaft (11) extending through and between said first and second side surfaces, said shaft (11) being supported by said machine table (3), a motor (15) directly coupled to said shaft (11) for rotating said shaft (11), a first cam disk (14) mounted to said shaft (11) adjacent said first side surface, a second cam disk (14) mounted to said shaft (11) adjacent said second side surface, and biasing means (21) for urging said projections (24) into pressing engagement with said cam disks (14).

2. Machine in accordance with claim 1, characterized by the fact that the side members of the bridge (17) include legs (19) arranged adjacent to the machine table (3).

3. Machine in accordance with claim 2, characterized by the fact that the bridge (17) is supported by a base plate (2) fixed to the machine table (3) and is movable relative to the base plate (2).

4. Machine in accordance with claim 3, characterized by the fact that said biasing means (21) are springs and the bridge (17) is spring mounted on the base plate (2) in the region of its legs (19).

5. Machine in accordance with claim 4, characterized by the fact that a compression spring (21) is located between each leg (19) of the bridge (17) and the base plate (2).

6. Machine in accordance with claim 5, characterized by the fact that the range of movement of the bridge (17) corresponds to an angle of traverse of the cam disks (14) which is more than 180°.

7. Machine in accordance with claim 6, characterized by the fact that the angle of traverse of the cam disks (14) is 270°.

8. Machine in accordance with claim 6, characterized by the fact that the bridge (17) is guided perpendicular to its direction of movement.

9. Machine in accordance with claim 8, characterized by the fact that the bridge (17) is guided by a plurality of sleeves (22), each said sleeve (22) being telescopically mounted to one of the legs (19).

10. Machine in accordance with claim 8, characterized by the fact that the motor is embodied as an electric motor.

11. Machine in accordance with claim 10, characterized by the fact that the motor is fixedly supported in the base plate (2) of the machine.

12. Machine in accordance with claim 4, characterized by the fact that the drive mechanism (15) has a gear unit directly coupling the motor (15) to the shaft (11).

13. Machine in accordance with claim 12, characterized by the fact that the projection (24) is a roller.

14. Machine in accordance with claim 12, characterized by the fact that the shaft (11) is rotatably supported on bearings in the machine table (3) and the cam disks (14) are fixedly connected to the shaft (11).

* * * * *